United States Patent [19]

Swinson

[11] 4,127,495

[45] Nov. 28, 1978

[54] NON-BUILT LIQUID DETERGENTS

[75] Inventor: Robert C. Swinson, New Castle, Del.

[73] Assignee: Hercules Incorporated, Wilmington, Del.

[21] Appl. No.: 870,799

[22] Filed: Jan. 19, 1978

[51] Int. Cl.[2] ..... C11D 1/831; C11D 3/22

[52] U.S. Cl. ..... 252/89 R; 252/550; 252/554; 252/558; 252/559

[58] Field of Search ..... 252/89, 550, 551, 554, 252/555, 558, 559, DIG. 15; 536/90, 91, 94, 95, 96

[56] References Cited

U.S. PATENT DOCUMENTS

| | | | |
|---|---|---|---|
| 1,877,856 | 9/1932 | Hagedorn et al. | 536/91 |
| 2,994,665 | 8/1961 | Reich et al. | 252/526 |
| 3,849,347 | 11/1974 | Tokiwa et al. | 252/545 |
| 3,869,399 | 3/1975 | Collins | 252/118 |

FOREIGN PATENT DOCUMENTS

| | | |
|---|---|---|
| 268,261 | 6/1966 | Australia. |
| 345,028 | 3/1931 | Fed. Rep. of Germany. |
| 678,445 | 9/1952 | United Kingdom. |
| 917,079 | 1/1963 | United Kingdom. |

*Primary Examiner*—P.E. Willis, Jr.
*Attorney, Agent, or Firm*—William S. Alexander

[57] ABSTRACT

Heavy duty, non-built liquid detergents are disclosed in which the anti-redeposition additive is benzyl hydroxyethyl cellulose or phenylhydroxyethyl hydroxyethyl cellulose.

1 Claim, No Drawings

NON-BUILT LIQUID DETERGENTS

This invention relates to the liquid detergent art. More specifically, it relates to a non-built liquid detergent composition containing a novel anti-soil redeposition agent.

Any laundry detergent, whether liquid or powdered, must not only remove soil from clothing but must prevent if from redepositing on the fabric as the wash water is removed. With powdered detergents, carboxymethyl cellulose has been widely used as an anti-redeposition agent. Other cellulose derivatives have also been employed. The incorporation of the cellulosic anti-redeposition agent into a powdered detergent composition presents no particular problem due to the powdered form of the detergent. With liquid detergents, however, a number of problems have been encountered.

The original heavy duty liquid detergents typically are comprised of one or more synthetic detergents or surfactants and a detergency builder. Most normally, the detergency builder is a phosphate or polyphosphate such as, e.g., tetrapotassium pyrophosphate. Detergents of this type, due to the presence of the detergency builder, have come to be known as "built liquid detergents."

The presence of phosphate detergency builders is undesirable for environmental reasons associated with the disposal of the detergent after use. For this reason, the trend in liquid detergents has been away from the so-called "built detergents" to non-built systems. In order to retain the high detergency level of the built systems, the non-built systems replace the phosphates with a higher concentration of surfactants.

A typical non-built liquid detergent is an aqueous solution of a mixture comprising about 30 to 40% by weight of a non-ionic surfactant and 10 to 15% by weight of an anionic surfactant. Other additives such as perfumes, additives to solubilize the surfactants, optical brighteners, dyes, perfumes and bacteriostats can also be included. Ethanol is used to reduce the viscosity of the detergent for ease of pouring and to assure solubility of the nonionic surfactant. Ethanolamines are often employed to insure alkalinity of the detergent.

Due to the high level of surfactant, and in particular due to the anionic surfactant content of these detergents, the conventionally used anti-redeposition agents have not been used with great success in non-built liquid detergents. The preferred conventional anti-redeposition agents is carboxymethyl cellulose (CMC). CMC is incompatible with anionic surfactant solutions and precipitates therefrom, forming a cloudy product initially and, upon sitting, a two-phase system as the CMC settles out. Such a product can still be used satisfactorily as a detergent, but, aesthetically, it is less pleasing, and as a result it is not commercially acceptable.

Now, in accordance with this invention, it has been found that certain low molecular weight modified hydroxyethyl celluloses are highly effective anti-redeposition agents not only in terms of their performance, but also due to their compatibility in liquid detergent formulations. Specifically low molecular weight hydroxyethyl cellulose modified by the addition of a small amount of benzyl or phenylhydroxyethyl substitution have been found to be highly effective anti-redeposition agents which are totally compatible in non-built liquid detergent formulations containing anionic surfactants.

Specifically stated, the invention is a non-built liquid detergent composition comprising an aqueous solution of a surfactant mixture containing about 30 to 40% by weight of a nonionic surfactant, 10 to 15% by weight of an anionic surfactant and about 0.25 to 2% of a soil anti-redeposition agent selected from the class consisting of (a) benzyl hydroxyethyl cellulose having benzyl D.S. of about 0.1 to 0.3, a hydroxyethyl M.S. of about 1.5 to 3 and a viscosity of 5% aqueous solution of about 75 to 400 cps; and (b) phenylhydroxyethyl hydroxyethyl cellulose having phenylhydroxyethyl M.S. of about 0.1 to 0.3, hydroxyethyl M.S. of about 1.5 to 3, and a viscosity in 5% aqueous solution of about 75 to 400 cps.

A preferred detergent composition comprises about 10 to 15% anionic surfactant, 30 to 40% nonionic detergent and 1 to 2% anti-redeposition agent.

The modified hydroxyethyl celluloses used as anti-redeposition agents in this invention are low molecular weight water-soluble ethers known in the art. The benzyl modified material is prepared by reacting alkali cellulose either simultaneously or serially with benzyl chloride and ethylene oxide to the correct substitution level using known etherification techniques. The phenylhydroxyethyl substituted ether is prepared with styrene oxide and ethylene oxide as the etherifying agents.

As stated, the benzyl D.S., i.e., the average number of hydroxyl groups per anhydroglucose unit which are substituted with benzyl groups, can be between 0.1 and 0.3, products modified to the highbenzyl substitution level being more soluble in the non-built liquid detergent compositions. Higher benzyl substitution than 0.3 is not harmful to the detergent, but neither is it helpful and thus it is economically disadvantageous to use greater than about 0.3. Preferably, the benzyl substitution will be between about 0.2 and 0.3.

The same considerations apply with respect to the phenylhydroxyethyl hydroxyethyl cellulose. The M.S., i.e., the average number of phenylhydroxyethyl residues present per anhydroglucose unit, can vary between 0.1 and 0.3 and preferably between 0.2 and 0.3.

In each case the lower limit — about 0.1 — is more critical than the upper limit. Surprisingly, it has been found that plain hydroxyethyl cellulose having the specified 1.5 to 3 M.S. value is neither compatible with the surfactant mixture required nor effective as an anti-redeposition agent. Thus, the 0.1 mole of benzyl or phenylhydroxyethyl substitution per anhydroglucose unit is required.

The other critical factor about the cellulose derivative is its molecular weight. Low molecular weight materials are required. Higher molecular weight materials are incompatible with the surfactant solutions. As with other polymers, molecular weight is expressed in terms of the viscosity of a solution. The usable cellulose derivatives are those which in 5% aqueous solution have a Brookfield viscosity of about 75 to 400 cps. at 25° C.

As stated, non-built heavy duty liquid detergents usually contain about 30 to 40% by weight nonionic surfactant and 10 to 15% by weight anionic surfactant. The most commonly used nonionic surfactants are linear alkyl phenols and fatty alcohols which have been ethoxylated to contain from 40 to 70% by weight of ethylene oxide. The alkyl group on the substituted phenol or in the fatty alcohol can contain from 10 to 18 carbon atoms. Anionic surfactants commonly used are linear alkyl benzene sulfonates, fatty alcohol sulfates and alkyl sulfonates. The alkyl group can contain from 10 to 18 carbon atoms. The alkyl group of the alkyl sulfonates may be saturated or unsaturated and straight or branched chain.

As has been suggested, the critical parameters by which the anti-redeposition agents of this invention are judged are their compatibility in the detergent solution and the degree of whiteness retention exhibited by a fabric when washed in the detergent in the presence of a standard oily soil.

Compatibility is the ability to dissolve in the detergent solution to form a clear, homogeneous solution free of insoluble matter. This is observed and judged visually. The solution must also be shelf-stable, i.e., no separation on sitting for several months.

Whiteness retention is determined by washing an equal number of soiled and clean white cloth swatches in a 0.25% solution of the detergent composition in question for 20 minutes at 44° C. Whiteness retention is expressed as the percentage of original reflectance of the unsoiled cloths retained after washing in the presence of the soiled cloths. The soiled cloths are soiled with an oily particulate soil consisting of cottonseed oil and carbon black. Test cloths (soiled and unsoiled) were purchased from U.S. Testing Co., Hoboken, New Jersey.

EXAMPLE 1

A commercial liquid detergent composition having the following approximate formulation 40% ethoxylated dodecyl alcohol
15% sodium lauryl benzene sulfonate
10% ethanol
10% triethanol amine
25% water was modified by adding thereto 0.5% by weight of a benzyl hydroxyethyl cellulose having benzyl D.S. of 0.25 and hydroxyethyl M.S. of about 2.5. The benzyl hydroxyethyl cellulosewas totally compatible in the detergent as evidenced by formation of a clear, homogeneous solution which showed no cloudiness or precipitation after sitting for two weeks.

A series of $3\frac{1}{2} \times 4\frac{1}{2}$ inch cloth swatches were washed with this detergent in a laboratory Terg-o-Tometer manufactured by Baker Instrument Co., Orange, New Jersey. Eight unsoiled swatches were washed in each test in contact with eight swatches soiled with a standard oily graphite soil at 44° C. in distilled water, hardened to 150 p.p.m. calculated as calcium carbonate (Ca:Mg = 2:1 wt./wt.). The swatches were then rinsed with lukewarm tap water and air dried. Anti-redeposition was determined by comparing the reflectance of the originally unsoiled cloths before and after washing:

$$\frac{\text{Final reflectance}}{\text{Initial reflectance}} \times 100 = \%\ \text{whiteness retention}$$

Table 1 records whiteness retention data for different types of cloth washed in this detergent and a control detergent of the same formulation containing no benzyl hydroxyethyl cellulose (BzHEC).

Table 1

| | Type of Cloth | Detergent | #Wash Cycles | Whiteness Retention |
|---|---|---|---|---|
| (a) | Cotton | Control | 1 | 71.9% |
| | Cotton | Control + 0.5% BzHEC | 1 | 79.6% |
| (b) | Wash & wear cotton | Control | 3 | 92.1% |
| | Wash & wear cotton | Control + 0.5% BzHEC | 3 | 94.2% |
| (c) | 50/50 Cotton/ polyester | Control | 5 | 87.9% |
| | 50/50 Cotton/ polyester | Control + 0.5% BzHEC | 5 | 92.9% |
| (d) | 50/50 Cotton/ polyester with permanent press finish | Control | 10 | 90.7% |
| | | Control + 0.5% BzHEC | 10 | 91.7% |
| (e) | Cotton[1] | Control | 5 | 88.3% |
| | | Control + 0.5% BzHEC | 5 | 91.8% |

[1]This specimen soiled with sebum dust soil.

EXAMPLE 2

A commercial heavy duty liquid detergent of the same formulation used in Example 1 was modified by addition thereto of various amounts of benzyl hydroxyethyl cellulose having benzyl D.S. of 0.25, and hydroxyethyl M.S. of about 2.5 whose 5% aqueous solution viscosity was about 140 cps. In all cases a clear, compatible solution was formed. Whiteness retention results are recorded in Table 2.

Table 2

| Fabric | Detergent | Whiteness Retention |
|---|---|---|
| Cotton | Control | 71 |
| Cotton | Control + 0.25% BzHEC | 73 |
| Cotton | Control + 0.5% BzHEC | 76 |
| Cotton | Control + 1% BzHEC | 81 |
| Cotton | Control + 1.5% BzHEC | 82 |
| Cotton | Control + 2% BzHEC | 83 |
| 50/50 cotton/ polyester | Control | 90 |
| 50/50 cotton/ polyester | Control + 0.25% BzHEC | 94 |
| 50/50 cotton/ polyester | Control + 0.5% BzHEC | 94 |
| 50/50 cotton/ polyester | Control + 1% BzHEC | 95 |
| 50/50 cotton/ polyester | Control + 1.5% BzHEC | 95 |
| 50/50 cotton/ polyester | Control + 2% BzHEC | 96 |

[1]One wash cycle for cotton; three cycles for blend fabric.

What I claim and desire to protect by Letters Patent is:

1. A non-built liquid detergent composition comprising an aqueous solution of a surfactant mixture containing about 30 to 40% by weight of a nonionic surfactant, 10 to 15% by weight of an anionic surfactant and about 0.25 to 2% of a soil anti-redeposition agent selected from the class consisting of (a) benzylhydroxyethyl cellulose having benzyl D.S. of about 0.1 to 0.3, a hydroxyethyl M.S. of about 1.5 to 3 and a viscosity in 5% aqueous solution of about 75 to 400 cps.; and (b) phenylhydroxyethyl hydroxyethyl cellulose having phenylhydroxyethyl M.S. of about 0.1 to 0.3, hydroxyethyl M.S. of about 1.5 to 3 and a viscosity in 5% aqueous solution of about 75 to 400.

* * * * *